United States Patent [19]

Annett, II

[11] 3,945,274

[45] Mar. 23, 1976

[54] SPEED WRENCH

[76] Inventor: Charles E. Annett, II, P.O. Box 311, Mantolooking, N.J. 07838

[22] Filed: Aug. 13, 1975

[21] Appl. No.: 604,095

[52] U.S. Cl. ..... 81/58.1

[51] Int. Cl.[2] ..... B25B 13/00

[58] Field of Search ..... 81/58.1, 57.31, 62, 63, 81/63.1, 63.2, 180 R

[56] References Cited

UNITED STATES PATENTS

| | | | |
|---|---|---|---|
| 1,601,767 | 10/1926 | Peterson | 81/58.1 |
| 2,520,443 | 8/1950 | Seaquist | 81/58.1 |
| 3,532,013 | 10/1970 | Haznar | 81/62 |
| 3,713,356 | 1/1973 | Knudsen | 81/62 |
| 3,762,245 | 10/1973 | Smyers | 81/180 R |

*Primary Examiner*—James L. Jones, Jr.
*Attorney, Agent, or Firm*—H. Hume Mathews

[57] ABSTRACT

A hand tool of the ratchet type is provided with a planetary gear system to enable the user to vary the output speed of the tool. In the preferred embodiment a ratched type socket wrench is provided with a planetary gear system and a hand grip in the form of a cap covering the system, with the sun gear coupled to the output, the tool handle coupled to the planet carrier and the hand grip coupled to the ring gear. If the hand grip is held against rotation by the operator while the handle is turned, the output will be driven at a speed greater than that of the handle, thus over-running the ratchet. If the resistance offered by the driven object, e.g. a nut, becomes large enough so that the hand grip may not conveniently be held, the operator may release the hand grip or slacken his hold thereof thus allowing the ratchet to engage and lock the handle to the output so that the handle will directly drive the output.

8 Claims, 6 Drawing Figures

SPEED WRENCH

BACKGROUND OF THE INVENTION

This invention is a hand tool of the ratchet type wherein a planetary gear system is provided to enable the user to selectively vary the output speed for a given input. In its preferred form the tool is a ratchet type socket wrench.

Hand and power tools have previously been provided with planetary gear systems for the purpose of increasing or decreasing output torque with resultant change in output speed. In some cases, multiple or variable output torques have been provided by the user selectively controlling the rotation of one or more of the members in the gear system. In the prior art, however, the means for selectively controlling one or more of the gear system members has involved the use of clutches or shifting means or other mechanical means.

In the present invention a hand tool of the ratchet type is provided with planetary gear means controlled by a hand grip in such a way that the user may conveniently control the output speed without having to select or adjust separate control means.

SUMMARY OF THE INVENTION

In the preferred embodiment a ratchet type socket wrench is provided with a planetary gear system controlled by a hand grip in the form of a knob or cap covering the system. The handle (input) is coupled to the planet carrier, the output is coupled to the sun gear and the cap is coupled to the ring gear so that the cap is rotatable with respect to the handle.

In use, the cap may be hand held against rotation as the handle is turned or reciprocated in a normal manner. This will cause the output to be driven at a speed substantially greater than that of the handle, thus overrunning the ratchet mechanism. If enough resistance is offered by the object to which the tool is applied so that the user may not conveniently hold the cap, it may be released or allowed to slip the user's hand, thus allowing the ratchet mechanism to engage and directly couple the handle to the output. While the handl is coupled directly to the output, the user may exert substantial torque to the load; however, at any time that the load is sufficiently small the user may hold the cap against rotation to multiply the output speed. Thus, at low load the output is driven at increased speed relative to handle movement but at high load the handle may be directly engaged to the output for direct drive, with no speed increase.

DETAILED DESCRIPTION OF A PREFERRED EMBODIMENT

Figure 1:
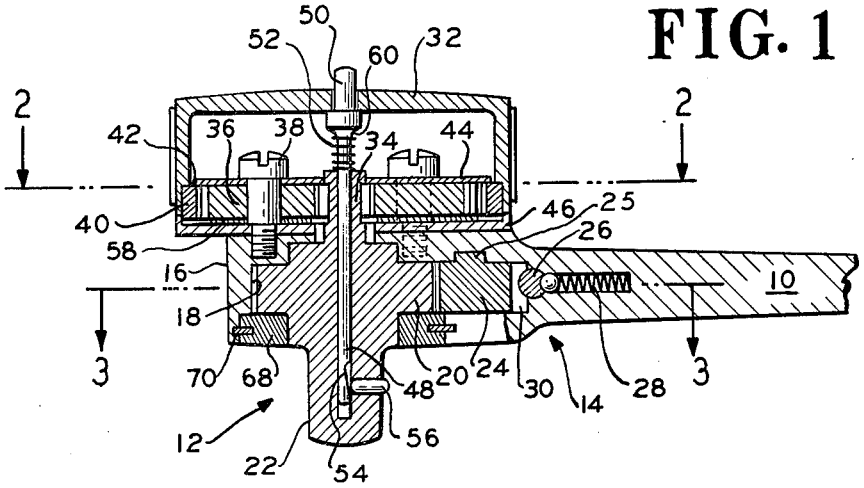
FIG. 1 is a vertical section of one embodiment of this invention, taken along line 1—1 of FIG. 2.

The preferred embodiment of this invention is an improvement to a conventional ratchet wrench which provides for variable speed of the output of the wrench. The conventional portion includes a handle 10, an output member, generally designated 12 and ratchet means 14. Typically, handle 10 has an enlarged integral end portion 16 with cavity 18 therein for receiving the output member 12, and the ratchet means 14. The output member 12 is of circular cross section and rotatable in cavity 18. Generally, output member includes a ratchet gear portion of relatively large diameter with ratchet teeth around its periphery, and an adapter 22 which extends through an opening in the end portion 16. Adapter 22 is shaped to accept a driving attachment such as a socket, or the like (not shown).

The ratchet means 14 may comprise a pawl 24, including an extension forming a stub shaft 25, rotatably received in cavity 18, an adjuster bar 26, and a spring and ball detent 28. Pawl 24 conventionally may have a tooth 30 in engagement with a notch in the adjuster bar 26 so that sliding movement of the adjuster bar 26, between detent positions, imparts limited rotative movement to the pawl 24. The pawl 24 may also have ratchet teeth to cooperatively engage the teeth on the ratchet gear portion 20 of the output member 12, comprising a conventional ratchet drive mechanism. This mechanism will allow the output member 12 to turn freely, relative to the handle, in one direction (clockwise with the ratchet means 14 in the position shown in the drawings) but not in the opposite direction. Typically, a sufficient amount of lost motion is built into the ratchet mechanism so that as the output member 12 rotates in one direction relative to the handle 10, the teeth of the pawl 24 will be pushed out of engagement with each successive tooth of the ratchet gear 20 without moving the adjuster bar 26 out of its detent position. When an attempt is made to turn the output member 12 in the opposite direction, however, the teeth of the pawl 24 and output member 12 lock up preventing relative rotation. In an ordinary ratchet wrench the ratchet mechanism acts as a one-way direct drive coupling between the handle and the output so that reciprocating motion of the handle is converted to intermittent one-way motion of the output.

It should be recognized that the foregoing is a brief description of a conventional ratchet type socket wrench having a handle 10 disposed at a right angle to the adapter 22. This description is provided for clarity and understanding of Applicant's improvement; however, the invention is not limited to this form of ratchet mechanism, or even to a socket wrench. The invention is easily adapted for use with ratchet screw drivers, drills or other tools regardless of the specific ratcheting mechanism or the disposition of the handle with respect to the output of the tool.

In the preferred embodiment, an improvement is provided to a conventional ratchet tool comprising a planetary gear system received within a shell or cap 32 associated with the ratchet mechanism. The planetary system includes a sun gear 34, at least one planet gear 36, a planet carrier 38 and a ring gear 40. The sun gear 34 is connected to the output member 12 and may be attached to or formed from an extension of output member 12 opposite to, but concentric with the axis of adapter 22. the planet gear 36 is supported in engagement with sun gear 34 by planet carrier 38 which is connected to the end portion 16 of handle 10. Advantageously, planet carrier 38 may comprise a single shoulder bolt for each planet gear 36, which is screwed into the end portion 16 in a conventional manner. The ring gear 40 is connected to the interior surface of the head 32 by screws, a press fit, or the like, so as to engage the planet gear 36. Preferably, ring gear 40 is mounted on the cap 32 so that its upper surface forms a shoulder 42, and upper and lower plates 44, 46 are provided to retain the entire assembly in proper position. With this arrangement the lower plate 46 abuts the end portion 16; the planetary gear system including the ring gear 40 is sandwiched between the upper and lower plates 44, 46, with the upper plate 44 bearing on the shoulder 42. The shoulder bolts (planet carrier) 38 extend throught he upper plate 44, planet gear 36 and lower plate 46 into the end portion 16 of the handle 10. It should be clear that other means may also be constructed to hold the planetary system and cap together; however, the cap 32 and ring gear 40 affixed thereto must be rotatable with respect to the end portion 16 of handle 10.

Spacers 58 may be provided between the lower plate 46 and the planet gear 36 to allow free rotation of the planet gear 36 on the planet carrier 38. A washer 68 may also be provided to close the bottom of end portion 16, and it may be held in place with snap ring 70.

The tool described, representing a preferred form of this invention, allows the application of variable speed to the driven object, e.g. a nut. If a nut is sufficiently loose and it is desired to turn it quickly, the operator may place one hand on the cap 32 and hold it against rotation as handle 10 is oscillated or turned in a conventional manner. While the operator holds the cap 32 fast, ring gear 40 will also be held and turning handle 10 will turn the planet carrier 38 in the same direction. Planet gear 36 will respond to the difference in rotation between the ring gear 40 and planet carrier 38 and drive sun gear 34, again in the same direction but at a greater speed than handle 10. Therefore, the output member 12, being connected to the sun gear 34, will also turn faster than handle 10. Since the output member 12 turns faster than handle 10, under these conditions a conventional ratcheting action will occur in ratchet mechanism 14, as earlier described. In effect the ratchet mechanism allows the output member 12 to overrun the ratchet mechanism 14 and consequently the handle 10.

If the resistance presented by the nut or other workpiece becomes too great, the operator will not be able to conveniently hold the cap 32 against rotation. Under these conditions, the operator may simply release or loosen his grip on the cap 32 and allow it to turn freely. When this occurs the ratchet mechanism 14 will immediately engage so that the handle 10 will directly drive the output member 12 as in a conventional ratchet wrench.

It may be seen that much greater speed of the output member 12 will result from holding cap 32 against rotation (depending on the planetary gear ratio selected), but with a consequent reduction in torque as compared with a conventional tool. If the cap 32 is freed, or allowed to slip in the user's hand, greater torque may be applied, but at a lower speed, directly through the ratchet mechanism. Of course, the limit of the amount of torque which may be applied while the cap 32 is held will depend on the strength of the operator. It should also be apparent that the output speed may be further increased if the operator is able to counter-rotate the cap 32 with respect to the handle 10.

Numerous variations of this invention may be conceived and should be apparent to those skilled in the art. The cap 32 may be shaped in various manners to provide a secure and comfortable grip, or an extension handle may be associated with the cap 32 to provide greater leverage. A quick eject mechanism may be added, as shown in FIG. 1, to provide for ejecting a socket or other tool from the adapter 22. As shown in FIG. 1, the output member 12 is drilled along its axis to accept push rod 48. Push rod 48 extends vertically out through an opening in the cap 32 to expose to the operator a push button 50 which is preferably integral with the push rod 48. A spring 52 biases push rod 48 and push button 50 away from the adapter end of the tool and push rod 48 is also provided with a notch 54 to receive the detent ball or rod 56 in the adapter 22 when push button 50 is depressed. Quick eject mechanism, such as the one briefly described here, are known in the art and any of them may be adapted to this invention.

Figure 2:
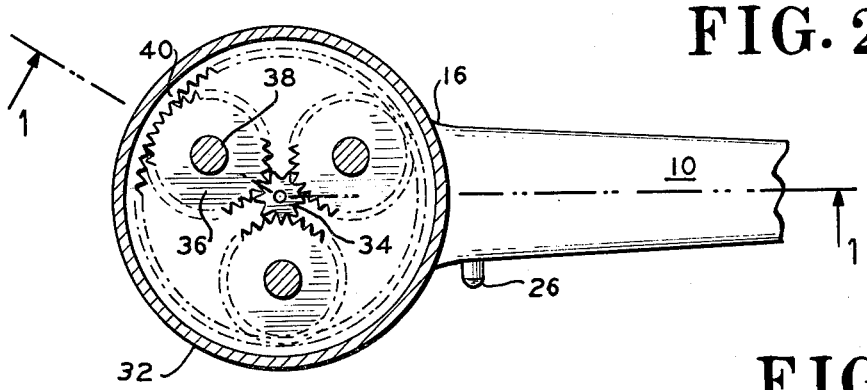
FIG. 2 is a sectional view taken at the line 2—2 shown in FIG. 1.
Figure 3:
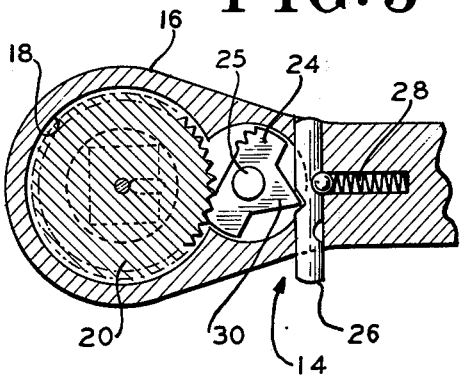
FIG. 3 is a sectional view taken at the line 3—3 shown in FIG. 1.
Figure 4:
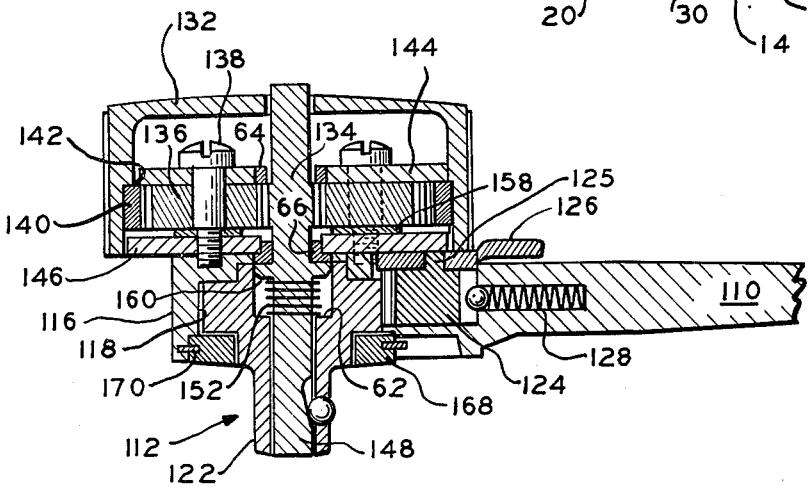
FIG. 4 is a vertical section of another embodiment of this invention.
Figure 6:
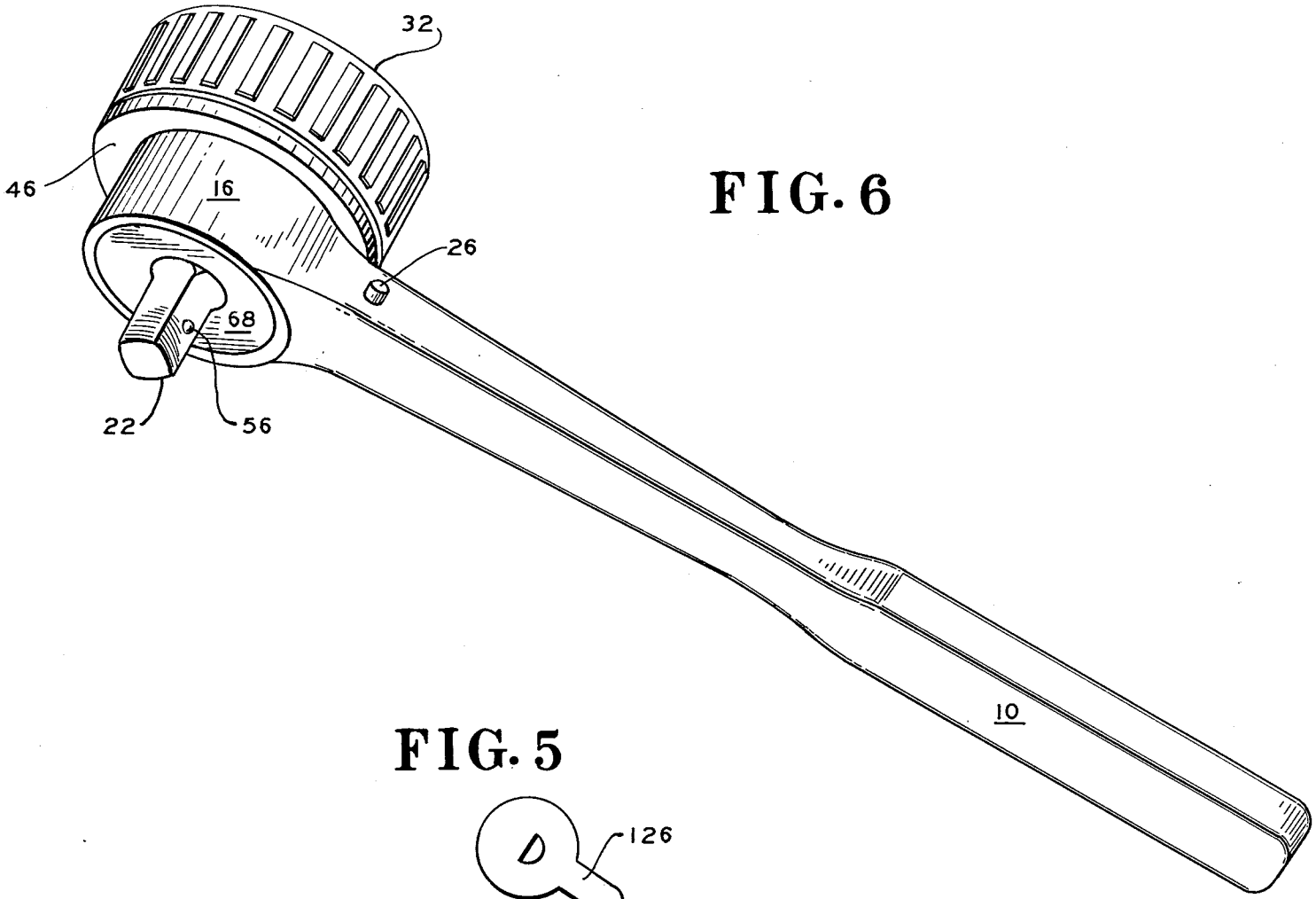
FIG. 6 is a perspective view of the embodiment illustrated in FIG. 1.
Figure 5:
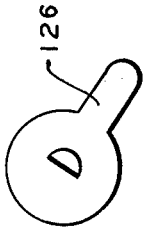
FIG. 5 is a detail of the handle of the ratchet pawl in the embodiment illustrated in FIG. 4.

FIG. 4 illustrates an alternative embodiment of this invention, including a quick eject mechanism for a socket attachment. In this FIG. 4, parts which are equivalent to parts shown in FIGS. 1 through 3 are numbered in like fashion, except that the prefix 1 has been added thereto. Items numbered without this prefix have no closely related counterpart described previously. In this embodiment the sun gear 134 is formed from or attached to the push rod 148 and the push rod 148 is drivingly connected to the output member 112. The spring 152 biases the push rod 148 in the same manner but it is relocated in a well 62, and it bears against a shoulder 160 on push rod 148. Bearings 64 and 66, and spacers 158 are also provided in this embodiment to more accurately align the push rod 148 and allow easy rotation of the parts. Additionally, the previously described adjuster bar 26 is replaced by lever 126 for control of the position of ratchet pawl 124. With this arrangement the adjuster lever controls pawl 124 through the split stub shaft 125 and the spring and ball detent 128 seats directly in depressions in the surface of the pawl 124.

While this invention has been described with inputs to each of the ring gear 40 and planet carrier 38, and with an output from the sun gear 34, it should be understood that the association of the inputs and output to each element of the planetary system may be changed subject to obtaining the same or similar function of the assembly. Additionally, the planetary system of this invention may utilize conical or hypoid gears, as well as ordinary straight tooth gears.

Numerous other embodiments and variations of this invention may be conceived by one skilled in the art. Therefore, it should be understood that the above descriptions are intended to be illustrative and not to limit the scope of the invention as claimed in the claims appended hereto.

I claim:

1. In a hand tool of the type having a rotatable output member and a handle connected by a ratchet means, the output member being selectively driven in either of two rotational directions by the ratchet means as the handle is turned, the improvement comprising:

a. a planetary gear system, including a ring gear, at least one planet carrier retaining and supporting a planet gear, and a sun gear connected to the output member;

b. a hand grip connected to the ring gear for restraining the ring gear against rotation at torques below a value determined by the restraining force applied to the hand grip by the hand of the operator;

c. means to couple said handle and said hand grip to an element of the planetary gear system so that turning the handle while the hand grip and the ring gear are held against rotation causes the output member to rotate at a greater rotational speed than the handle and thus to overrun the ratchet means, said ratchet means being automatically effective to engage the handle to the output member directly with no increase in rotational speed of the output member relative to the handle, when the torque on the ring gear exceeds the restraining force of the operator's hand on the hand grip.

2. The device of claim 1 further comprising an adaptor connected to the output member for receiving a socket tool, a detent ball supported by the adapter for retaining the socket tool on the adapter, a push rod supported within the adapter and having a notch therein for receiving the detent ball when the push rod is moved against bias means normally biasing the push rod away from a position where the notch will receive the detent ball.

3. The device of claim 2 wherein the push rod extends through the hand grip to form a push button which may be depressed to move the notch into position to receive the detent ball.

4. The device of claim 2 wherein the sun gear is attached to the push rod and the push rod is drivingly connected to the output member.

5. A hand operated ratchet tool comprising:

a. a handle;

b. a body portion affixed to the handle and having a cavity therein;

c. an output member rotatable in said cavity;

d. ratchet means connecting the handle and the output member so that when the handle is turned the output member may be driven directly through the ratchet;

e. a planetary gear system having a sun gear, at least one planet gear, at least one planet carrier and a ring gear;

f. a hand grip;

g. means connecting the hand grip and the planetary gear system to couple the handle, the hand grip and the output member to elements of the planetary gear system so that when the hand grip is restrained against rotation by the frictional force of the operator's hand on the hand grip the output member will rotate in the same direction as, but faster than the handle, thus overrunning the ratchet means, as the handle is turned and so that when the torque applied to the hand grip exceeds the said frictional restraining force the hand grip will slip within the operator's hand and slow the speed of rotation of the output member relative to the handle to the point whereat the ratchet engages automatically to provide a direct drive between the handle and the output member.

6. The device of claim 5 further comprising an adapter connected to the output member for receiving a socket tool and holding means to retain the socket on the adapter.

7. The device of claim 6 further comprising means to control the holding means including a push rod supported within the adapter and extending through the head to form a push button, said control means being operable to release the holding means when the push button is depressed.

8. The device of claim 7 wherein the sun gear is coupled to the push rod and the push rod is drivingly connected to the output member.

* * * * *